US011446543B2

(12) United States Patent
Jin et al.

(10) Patent No.: US 11,446,543 B2
(45) Date of Patent: Sep. 20, 2022

(54) RUNNING DECK ASSEMBLY AND TREADMILL

(71) Applicants: BEIJING KINGSMITH TECHNOLOGY CO., LTD., Beijing (CN); BEIJING XIAOMI MOBILE SOFTWARE CO., LTD., Beijing (CN)

(72) Inventors: Guoqiang Jin, Beijing (CN); Xiaohui Zhang, Beijing (CN); Zhifeng Jing, Beijing (CN); Wei Wang, Beijing (CN); Chuangqi Li, Beijing (CN)

(73) Assignees: Beijing Kingsmith Technology Co., Ltd., Beijing (CN); Beijing Xiaomi Mobile Software Co., Ltd., Beijing (CN)

( * ) Notice: Subject to any disclaimer, the term of this patent is extended or adjusted under 35 U.S.C. 154(b) by 1 day.

(21) Appl. No.: 16/396,445

(22) Filed: Apr. 26, 2019

(65) Prior Publication Data

US 2019/0247709 A1 Aug. 15, 2019

Related U.S. Application Data

(63) Continuation of application No. PCT/CN2018/102036, filed on Aug. 23, 2018.

(30) Foreign Application Priority Data

Nov. 27, 2017 (CN) ..... 201711202678.8

(51) Int. Cl.
*A63B 22/02* (2006.01)

(52) U.S. Cl.
CPC ..... *A63B 22/0285* (2013.01); *A63B 22/0207* (2015.10); *A63B 22/0235* (2013.01); *A63B 2209/00* (2013.01); *A63B 2210/50* (2013.01)

(58) Field of Classification Search
CPC ..... A63B 21/4001; A63B 2210/50; A63B 2210/52; A63B 2210/54; A63B 2210/56;
(Continued)

(56) References Cited

U.S. PATENT DOCUMENTS 1,426,712 A 8/1922 Chatfield
4,505,476 A * 3/1985 Rubin ..... A63B 22/02 482/147

(Continued)

FOREIGN PATENT DOCUMENTS

CN 1531451 A 9/2004
CN 204134121 U * 2/2005 ..... A63B 22/0285

(Continued)

OTHER PUBLICATIONS

Written Opinion of the International Searching Authority PCT, dated Nov. 2017 (Year: 2017).*

(Continued)

*Primary Examiner* — Loan B Jimenz
*Assistant Examiner* — Thao N Do
(74) *Attorney, Agent, or Firm* — Arch & Lake LLP

(57) ABSTRACT

A running deck assembly and a treadmill are provided. The running deck assembly includes: a front running deck; a rear running deck, wherein a front end face of the rear running deck is hinged with a rear end face of the front running deck by a hinge, and a hinging gap is located at a location where the front running deck is hinged to the rear running deck; an annular running belt, which is rotatably mounted around the front running deck and the rear running deck with a clearance; and a flexible layer, which is laid on an upper surface of the front running deck and an upper surface of the rear running deck and covers the hinging gap.

15 Claims, 9 Drawing Sheets

(58) Field of Classification Search

CPC ..... A63B 2210/58; A63B 71/0036; A63B 2208/0204; A63B 22/02; A63B 22/0007; A63B 22/0214; A63B 22/0221; A63B 22/0235; A63B 22/0242; A63B 22/025; A63B 22/0257; A63B 22/0264; A63B 22/0271; A63B 22/0278; A63B 22/0285; A63B 22/0292; A63B 22/04; A63B 22/06; A63B 22/0605; A47B 13/08; A47B 13/088; A47B 13/10

USPC ..... 482/54, 4, 51

See application file for complete search history.

(56) References Cited

U.S. PATENT DOCUMENTS

| | | | | | |
|---|---|---|---|---|---|
| 4,757,987 | A * | 7/1988 | Allemand | A63B 22/02 | 482/54 |
| 5,279,528 | A * | 1/1994 | Dalebout | A63B 22/0023 | 482/54 |
| 5,314,180 | A * | 5/1994 | Yamagishi | A63B 60/54 | 473/535 |
| 5,330,392 | A * | 7/1994 | Bresin | A63B 37/0002 | 473/130 |
| 5,533,951 | A * | 7/1996 | Chang | A63B 22/02 | 198/841 |
| 5,542,892 | A * | 8/1996 | Buhler | A63B 22/02 | 482/54 |
| 5,820,438 | A * | 10/1998 | Horton, III | A63B 60/00 | 446/213 |
| 5,976,061 | A * | 11/1999 | Moon | A63B 22/0214 | 482/54 |
| 6,005,041 | A * | 12/1999 | Cook | A63B 21/06 | 524/439 |
| 6,123,648 | A | 9/2000 | Stevens | | |
| 6,186,208 | B1 * | 2/2001 | McGilvery | B65B 35/50 | 156/566 |
| 6,290,610 | B1 * | 9/2001 | Reid, Jr. | A63B 37/0003 | 473/356 |
| 6,352,485 | B1 * | 3/2002 | Philpot | A63B 59/51 | 473/567 |
| 6,454,683 | B1 * | 9/2002 | Kaye | A63B 71/0036 | 482/904 |
| 6,796,811 | B1 * | 9/2004 | Pupkiewicz | H01R 13/2414 | 439/91 |
| 7,780,578 | B2 * | 8/2010 | Packham | A63B 22/02 | 482/4 |
| 10,589,147 | B1 * | 3/2020 | Kostadis | A63B 22/025 | |
| 2001/0018378 | A1 * | 8/2001 | Burger | A63B 60/10 | 473/561 |
| 2002/0103039 | A1 * | 8/2002 | Shmoldas | A63B 53/04 | 473/340 |
| 2002/0103057 | A1 * | 8/2002 | Watterson | A63B 22/0023 | 482/54 |
| 2002/0151413 | A1 * | 10/2002 | Dalebout | A63B 22/02 | 482/54 |
| 2005/0164836 | A1 * | 7/2005 | Harker | A63B 22/205 | 482/52 |
| 2006/0142125 | A1 | 6/2006 | Pan et al. | | |
| 2006/0205568 | A1 * | 9/2006 | Huang | A63B 22/0207 | 482/54 |
| 2006/0272275 | A1 | 12/2006 | Riesmeier | | |
| 2007/0020972 | A1 * | 1/2007 | Shukla | H01H 13/70 | 439/86 |
| 2007/0087920 | A1 | 4/2007 | Dachraoui | | |
| 2008/0234111 | A1 * | 9/2008 | Packham | A63B 22/02 | 482/54 |
| 2008/0280734 | A1 * | 11/2008 | Dickie | A63B 22/0023 | 482/54 |
| 2009/0062072 | A1 | 3/2009 | Packham | | |
| 2011/0152037 | A1 | 6/2011 | Wu et al. | | |
| 2013/0092096 | A1 * | 4/2013 | Rosenberg | A01K 15/027 | 119/703 |
| 2013/0130869 | A1 | 5/2013 | Hou et al. | | |
| 2015/0111673 | A1 * | 4/2015 | Tomantschger | B32B 15/20 | 473/561 |
| 2015/0201748 | A1 | 7/2015 | Nivens et al. | | |
| 2015/0314184 | A1 * | 11/2015 | Moya Saez | A63B 69/16 | 482/61 |
| 2016/0144224 | A1 | 5/2016 | Dalebout et al. | | |
| 2016/0144225 | A1 * | 5/2016 | Dalebout | A63B 22/02 | 482/54 |
| 2016/0211653 | A1 * | 7/2016 | Linton | H01T 13/06 | |
| 2017/0172331 | A1 * | 6/2017 | Publicover | B32B 7/022 | |
| 2017/0333748 | A1 * | 11/2017 | Becker | A63B 22/0228 | |
| 2018/0044934 | A1 * | 2/2018 | Hall | E04H 4/0043 | |
| 2018/0177290 | A1 | 6/2018 | Kim | | |
| 2018/0345068 | A1 * | 12/2018 | Beyer | A63B 24/0087 | |
| 2018/0361194 | A1 * | 12/2018 | Corbalis | A63B 22/0214 | |
| 2020/0215380 | A1 * | 7/2020 | Xing | A63B 22/0046 | |

FOREIGN PATENT DOCUMENTS

| | | | | |
|---|---|---|---|---|
| CN | 202756886 U | | 2/2013 | |
| CN | 204134121 | * | 9/2014 | A63B 22/02 |
| CN | 204393943 U | | 6/2015 | |
| CN | 104801012 A | | 7/2015 | |
| CN | 204522128 U | | 8/2015 | |
| CN | 205019639 U | | 2/2016 | |
| CN | 107349562 A | | 11/2017 | |
| CN | 107773913 A | | 3/2018 | |
| CN | 107854807 A | | 3/2018 | |
| CN | 207769064 U | | 8/2018 | |
| CN | 207769065 U | | 8/2018 | |
| CN | 210409369 U | | 4/2020 | |
| JP | S54173588 U | | 12/1979 | |
| JP | 3054892 U | | 12/1998 | |
| JP | 3061053 U | | 9/1999 | |
| JP | 2014147653 A | | 8/2014 | |
| KR | 20090058196 A | | 6/2009 | |
| KR | 101281963 B1 | | 7/2013 | |
| RU | 2563789 C2 | | 9/2015 | |
| SU | 1715374 | | 2/1992 | |

OTHER PUBLICATIONS

CN-204134121-U_CHEN_Translated (Year: 2005).*

English translation of the Written Opinion of the International Search Authority and International Search Report of PCT Application No. PCT/CN2018/102036, dated Nov. 16, 2018, (7p).

First Office Action of the Korean Application No. 10-2019-7008475, dated Mar. 25, 2020 with English translation, (14p).

First Office Action of the Japanese Application No. 2019-528761, dated Jun. 3, 2020 with English translation, (9p).

International Search Report and Written Opinion issued in PCT/CN2018/102036, dated Nov. 16, 2018, 10 pages.

First Office Action of the Chinese application No. 201711202678.8, dated Feb. 22, 2019, 13 pages.

Chinese First Office Action and Search Report issued in CN201711203566.4, dated Apr. 29, 2019, 7 pages.

Chinese Notification to Grant Patent (including English translation) issued in CN201711203566.4, dated Aug. 10, 2020, 3 pages.

Chinese Second Office Action (including English translation) issued in CN201711203566.4, dated Feb. 3, 2020, 8 pages.

Chinsese Second Office Action (including English tranlsation) issued in CN201711202678.8, dated Nov. 20, 2019, 13 pages.

Chinsese Third Office Action (including English tranlsation) issued in CN201711202678.8, dated Jul. 3, 2019, 14 pages.

International Search Report and Written Opinion (including English translation) issued in PCT/CN2018/102039, dated Nov. 14, 2018, 11 pages.

Japanese First Office Action (with English tranlsation) issued in JP2019528767, dated Jun. 9, 2020, 8 pages.

Korean Final Rejection (including English translation) issued in KR20197008471 dated Sep. 2, 2020, 5 pages.

Korean Final Rejection (including English translation) issued in KR20197008475 dated Sep. 2, 2020, 4 pages.

(56) References Cited

OTHER PUBLICATIONS

Korean First Office Action (including English translation) issued in KR20197008475, dated Mar. 25, 2020, 14 pages.
Korean Written Opinion (including English translation) issued in KR20197008471 dated May 20, 2020, 15 pages.
Korean Written Opinion (including English translation) issued in KR20197008475 dated May 20, 2020, 14 pages.
Russian First Office Action (including English translation) issued in RU2020114613, dated Jul. 14, 2020, 10 pages.
Russian Notice of Allowance (including English translation) issued in RU2020114438, dated Jul. 28, 2020, 15 pages.
U.S. Non-Final Office Action issued in U.S. Appl. No. 16/396,430, dated Aug. 10, 2020, 54 pages.
Second Office Action of the Japanese application No. 2019-528761, dated Mar. 5, 2021, (7p).
Final Office Action of the U.S. Appl. No. 16/396,430, dated Jan. 6, 2021, (162p).
Second Office Action of the Japanese application No. 2019-528767, dated Jan. 5, 2021, (7p).
Notice of Advisory Action of the U.S. Appl. No. 16/396,430, dated Mar. 12, 2021, (5p).
First Office Action after RCE of the U.S. Appl. No. 16/396,430, dated May 5, 2021, (156p).
Final Office Action after RCE of the U.S. Appl. No. 16/396,430, dated Dec. 20, 2021, (178p).
Notice of Allowance of the U.S. Appl. No. 16/396,430, dated Apr. 13, 2022, (168p).

* cited by examiner

RUNNING DECK ASSEMBLY AND TREADMILL

CROSS-REFERENCE TO RELATED APPLICATION

The present application is based upon and claims the priority of PCT patent application No. PCT/CN2018/102036 filed on Aug. 23, 2018 which claims benefit of a Chinese Patent Application No. 201711202678.8, filed on Nov. 27, 2017, the contents of which are incorporated by reference herein in its entirety.

TECHNICAL FIELD

The present disclosure relates to the field of fitness equipment, and particularly to a running deck assembly and a treadmill.

BACKGROUND

A treadmill includes a running deck assembly, a driving assembly configured to drive the running deck assembly in operation, and a control assembly configured to control the driving assembly. The running deck assembly is generally placed on the ground and occupies a large area, and is difficult to store. In view of this, it is desirable to provide a foldable running deck assembly.

SUMMARY

The present disclosure provides a running deck assembly and a treadmill.

According to a first aspect of the present disclosure, a running deck assembly is provided, which includes: a front running deck and a rear running deck. The front end face of the rear running deck is hinged with a rear end face of the front running deck by a hinge, and a hinging gap is located at a location where the front running deck is hinged to the rear running deck. An annular running belt, which is rotatably mounted around the front running deck and the rear running deck with a clearance. The treadmill further includes a flexible layer, which is laid on an upper surface of the front running deck and an upper surface of the rear running deck and covers the hinging gap.

According to a second aspect of the embodiments of the present disclosure, a treadmill is provided, which includes a running deck assembly including: a front running deck and a rear running deck. A front end face of the rear running deck is hinged with a rear end face of the front running deck by a hinge, and a hinging gap is located at a location where the front running deck is hinged to the rear running deck. An annular running belt, which is rotatably mounted around the front running deck and the rear running deck with a clearance. The treadmill further includes flexible layer, which is laid on an upper surface of the front running deck and an upper surface of the rear running deck and covers the hinging gap.

It is to be understood that both the foregoing general description and the following detailed description are exemplary only and are not restrictive of the present disclosure.

BRIEF DESCRIPTION OF DRAWINGS

For the purpose of illustrating the technical solutions provided by examples of the present disclosure more definitely, the drawings used in the description of the examples will be presented briefly below. It is apparent that the drawings in the description below only show some examples of the present disclosure, and those skilled in the art may obtain other drawings according to these drawings without any creative work.

DETAILED DESCRIPTION

Figure 1A:
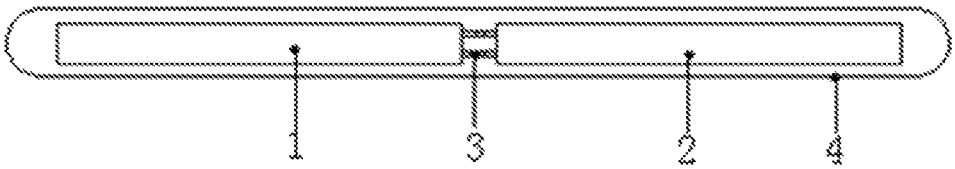
FIG. 1A is a front view of a running deck assembly, in an unfolded state, according to an example.

The examples of the present disclosure will be further described in detail with the reference to the drawings.

Reference is made in detail to exemplary aspects, examples of which are illustrated in the accompanying drawings. The following description refers to the accompanying drawings in which the same numerals in different drawings represent the same or similar elements unless otherwise indicated. The implementations set forth in the following description of exemplary aspects do not represent all implementations consistent with the present disclosure. Instead, they are merely examples of apparatuses and methods consistent with aspects related to the present disclosure.

The terminology used in the present disclosure is for the purpose of describing particular examples only and is not intended to limit the present disclosure. As used in this disclosure and the appended claims, the singular forms "a", "an", and "the" are intended to include the plural forms as well, unless the context clearly indicates otherwise. It should also be understood that the term "and/or" as used herein refers to and includes any and all possible combinations of one or more of the associated listed items.

It should be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The term "flexible" that describes a property of a material may be used interchangeably with "soft" or "soft flexible". The term "transmission" may be used to refer to a motion of a running belt when it is driven.

It should be understood that the expression "the annular running belt 4 is rotatably mounted around the front running deck 1 and the rear running deck 2 with a clearance"

mentioned in the examples of the present disclosure means: firstly, the front running deck 1 and the rear running deck 2 are accommodated within the annular running belt 4, and in an in situ state without any external force, there is a gap between the annular running belt 4 and the front and the rear running decks 1, 2, which are not in direct contact; secondly, the annular running belt 4 may rotate around the front running deck 1 and the rear running deck 2, and be able to allow a transmission, i.e. the annular running belt 4 may roll around the front running deck 1 and the rear running deck 2. That is to say, the annular running belt 4 is mounted around the front running deck 1 and the rear running deck 2 with a clearance, and is able to roll around the front running deck 1 and the rear running deck 2. In addition, the annular running belt 4 may adaptively make contact with the front running deck 1 or the rear running deck 2 when the feet of the user step on the annular running belt 4.

Figure 2A:
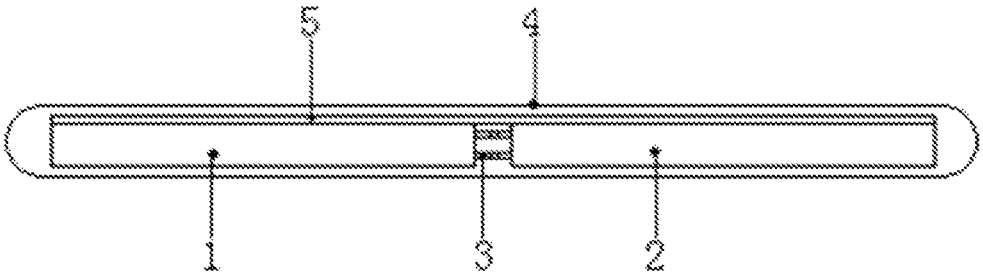
FIG. 2A is a front view of a running deck assembly according to an example.

The examples of the present disclosure provide a running deck assembly as shown in FIG. 2A, including: a front running deck 1; a rear running deck 2, and an annular running belt 4. A front end face of the rear running deck is hinged with a rear end face of the front running deck 1 by a hinge 3, and a hinging gap is located at a location where the front running deck 1 is hinged to the rear running deck 2; The annular running belt 4 is rotatably mounted around the front running deck 1 and the rear running deck 2 with a clearance.

The running deck assembly further includes a soft or flexible layer 5, which is laid on an upper surface of the front running deck 1 and an upper surface of the rear running deck 2 and covers the hinging gap.

Figure 1B:
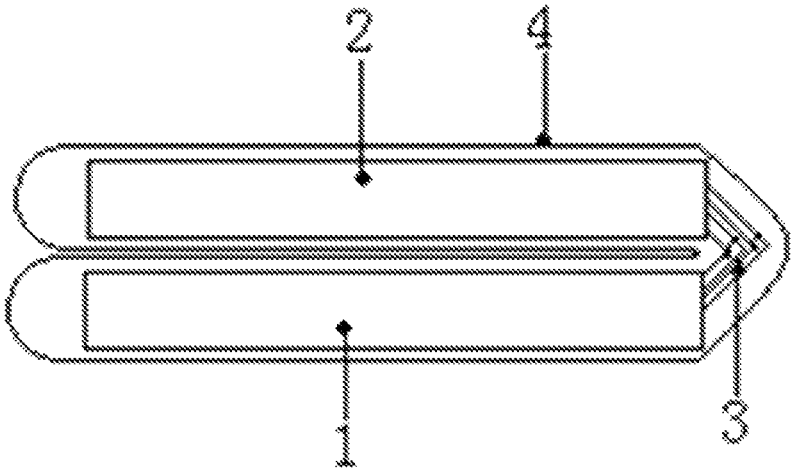
FIG. 1B is a front view of a running deck assembly, in a folded state, according to an example.

In an example, as shown in FIG. 1A, the running deck assembly includes: a front running deck 1; a rear running deck 2, having a front end face being hinged with a rear end face of the front running deck 1 by means of a hinge 3; and an annular running belt 4 mounted around the front running deck 1 and the rear running deck 2 with a clearance and being able to allow a transmission. There is a hinging gap located at a location where the front running deck 1 is hinged to the rear running deck 2, such that the rear running deck 2 may be folded up to the front running deck 1. In normal use, the front running deck 1 and the rear running deck 2 are unfolded and form an integral running deck, as shown in FIG. 1A; if it is necessary to fold the running deck, the rear running deck 2 may be folded up onto the front running deck 1 along the hinge 3, and a part of the annular running belt 4 facing the rear running deck 2 is also folded accordingly at the same time, as shown in FIG. 1B.

In the example, since the front running deck 1 of the foldable running deck assembly is hinged with the rear running deck 2, there is a hinging gap between the front running deck 1 and the rear running deck 2. The user may feel uncomfortable when doing exercise on the annular running belt 4 above the hinging gap. The examples of the present disclosure provide a running deck assembly by providing the soft layer 5 laying on the upper surfaces of the front running deck 1 and the rear running deck 2 and covering the hinging gap. The soft layer not only may cover the "recess" formed by the hinging gap, but also does not affect the folding and unfolding of the front running deck 1 and of the rear running deck 2 due to the flexibility property of the soft layer 5. This arrangement prevents the user from feeling discomfort on feet when doing exercise on the annular running belt 4 above the hinging gap by covering the "recess" formed by the hinging gap. Furthermore, the soft layer 5 may also reduce impact and vibration between the annular running belt 4 and the front and rear running decks 1, 2, thereby further improving the experience of the user when the user does exercise on the running deck assembly.

Moreover, even if there is a drop between the front running deck 1 and the rear running deck 2, it may be covered or smoothed by laying the soft layer 5 on the front running deck and the rear running deck. As a result, running comfort for the user may be improved.

It should be understood that in normal use of the running deck assembly according to the examples of the present disclosure, the front running deck 1 and the rear running deck 2 are unfolded and form an integral running deck. If it is necessary to fold the running deck, the rear running deck 2 may be folded up to the front running deck 1 along the hinge 3 (or the front running deck 1 may be folded up to the rear running deck 2 along the hinge 3), meanwhile, a part of the annular running belt 4 and a part of the soft layer 5 facing the rear running deck 2 are also folded accordingly.

In an example, the soft layer 5 is laid on a part of or the entire upper surface of the front running deck 1 and on a part of or the entire the upper surface of the rear running deck 2. A laying area of the soft layer 5 is not specifically limited, as long as the hinging gap is covered by the soft layer 5 to allow the comfort exercise of the user on the annular running belt 4 above the hinging gap.

In an example, the laying area of the soft layer 5 may be less than a sum of an upper surface area of the front running deck 1 and an upper surface area of the rear running deck 2.

In an example, the laying area of the soft layer 5 may be equal to a sum of the upper surface area of the front running deck 1, the upper surface area of the rear running deck 2 and an upper surface area of the hinging gap.

In an example, the laying area of the soft layer 5 may be larger than a sum of the upper surface area of the front running deck 1, the upper surface area of the rear running deck 2 and the upper surface area of the hinging gap while the soft layer 5 does not affect the folding, unfolding and use of the running deck assembly according to the examples of the present disclosure.

The soft layer 5 may be laid on the upper surface of the front running deck 1 and the upper surface of the rear running deck 2 in various ways. The following exemplary description is given with easy setting and high connecting strength.

In an example, the soft layer 5 is laid on the upper surface of the front running deck 1 and on the upper surface of the rear running deck 2 by adhering. The adherence is a method that facilitates firm connections between the soft layer 5 and the front and rear running decks 1, 2 which are made of different materials, and that is simple to perform.

In an example, the soft layer 5 may be adhered on the upper surface of the front running deck 1 and on the upper surface of the rear running deck 2 by means of super glue, such as 3M super glue.

For the purpose of improving an adhesion between the soft layer 5 and the front and rear running decks 1, 2, a rough structure may be provided on an adhesive face of the front running deck 1 and an adhesive face of the rear running deck 2, to improve an adhesive strength between the adhesive faces and the super glue layer. The rough structure may be a groove for receiving the super glue, which may have a circular, rectangular, or triangular structure, or other regular or irregular structures, such that more super glue is received between the soft layer 5 and the front and rear running decks 1, 2, and thus the connecting strength between the soft layer 5 and the front and rear running decks 1, 2 is reinforced.

In an example, the soft layer 5 may also be fixed on the upper surface of the front running deck 1 and on the upper surface of the rear running deck 2 by means of fastening tapes. The fastening tapes not only can ensure a firm connection between the soft layer 5 and the front and rear running decks 1, 2, but also facilitates the assembly or disassembly between the soft layer 5 and the front and rear running decks 1, 2.

The fastening tapes may be Velcro tapes, including nylon hook tapes and nylon loop tapes. For example, the nylon hook tape may be provided on a lower surface of the soft layer 5, and the nylon loop tape may be provided on the upper surface of the front running deck 1 and the upper surface of the rear running deck 2, such that the soft layer 5 may be laid on the upper surface of the front running deck 1 and on the upper surface of the rear running deck 2 by engagement of the nylon hook tapes and the nylon loop tapes.

In another example, the soft layer 5 may be laid on the upper surface of the front running deck 1 and on the upper surface of the rear running deck 2 by snap-fitting. The snap-fitting manner not only can ensure a firm connecting between the soft layer 5 and the front and rear running decks 1, 2, but also facilitates the assembly or disassembly between the soft layer 5 and the front and rear running decks 1, 2.

In an example, the lower surface of the soft layer 5 may be provided with multiple male or female members, and the upper surface of the front running deck 1 and the upper surface of the rear running deck 2 may be provided with multiple female or male members, then the connection between the soft layer 5 and the front and rear running decks 1, 2 may be implemented by the adaptive engagement of the male members with the female members. When a disassembly is required, one just needs to lift the soft layer 5 upwards.

Alternatively, the lower surface of the soft layer 5 may be provided with multiple fixture blocks, and the upper surfaces of the front running deck 1 and the rear running deck 2 may be provided with multiple fixture grooves adapted to the fixture blocks, then the connection between the soft layer 5 and the front and rear running decks 1, 2 may be implemented by the adaptive engagement of the fixture blocks with the fixture grooves. When a disassembly is required, one just needs to lift the soft layer 5 upwards.

A thickness of the soft layer 5 may be chosen according to specific applications. In an example, the thickness of the soft layer 5 may be between 0.8 mm and 1.2 mm, for example 0.8 mm, 0.9 mm, 1.0 mm, 1.1 mm, 1.2 mm, etc. The thickness of the soft layer 5 is chosen in such a way that the comfort of the user during running may be improved while a poor touch experienced by the feet of the user due to an excessively soft layer 5 may be avoided.

The soft layer 5 may be made of various materials with excellent softness and plasticity. In an example, the soft layer 5 may be made of ethylene-vinyl acetate copolymer or polyethylene.

The use of ethylene-vinyl acetate copolymer (EVA) provides the soft layer 5 with excellent properties in terms of water resistance, corrosion resistance, plasticity, processability, anti-vibration and sound insulation or the like. The use of polyethylene (PE) provides the soft layer 5 with excellent properties in terms of water resistance, corrosion resistance and plasticity or the like. Further, EVA and PE have a low cost and are easy to obtain.

In the running deck assembly according to the examples of the present disclosure, the soft or flexible layer is laid on upper surfaces of the front running deck and the rear running deck and covers the hinging gap. The soft layer not only may cover the "recess" formed by the hinging gap, but also does not affect the folding and unfolding of the front running deck and the rear running deck due to the flexibility property of the soft layer. This arrangement prevents the user from feeling discomfort on feet when doing exercise on the annular running belt above the hinging gap by covering the "recess" formed by the hinging gap. Furthermore, the soft layer may also reduce impact and vibration between the annular running belt and the front and rear running decks, thereby further improving the experience of the user when the user does exercise on the running deck assembly.

Figure 2B:
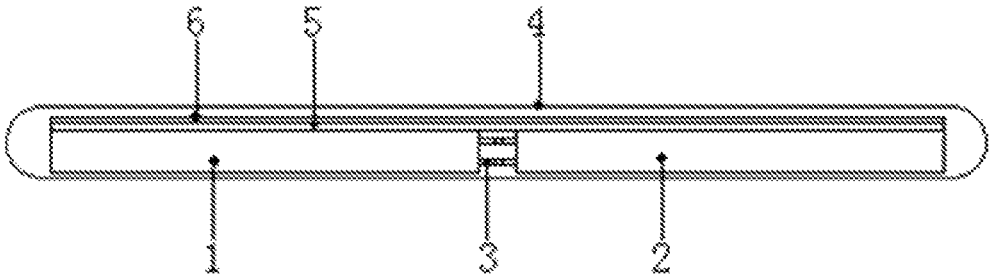
FIG. 2B is a front view of a running deck assembly provided with a wear-resisting layer according to another example.

For the purpose of preventing the annular running belt 4 from wearing the soft layer 5 during transmission, in an example shown in FIG. 2B, the running deck assembly according to the examples of the present disclosure further includes a wear-resisting layer. The wear-resisting layer 6 is laid on an upper surface of the soft layer 5.

It should be understood that the wear-resisting layer 6 should have good plasticity, and should not affect the folding and unfolding of the running deck assembly according to the examples of the present disclosure.

The wear-resisting layer 6 may be laid on the upper surface of the soft layer 5 in various ways. The following exemplary description is given with easy setting and high connecting strength.

In an example, the wear-resisting layer 6 is laid on the upper surface of the soft layer 5 by adhering. The adhering facilitates the firm connection between the soft layer 5 and the wear-resisting layer 6 made of different materials and is simple to perform.

In an example, the wear-resisting layer 6 may be adhered on the upper surface of the soft layer 5 by super glue.

In an example, the wear-resisting layer 6 may be fixed on the upper surface of the soft layer 5 by fastening tapes.

The arrangement for the super glue or the fastening tapes may refer to the above description regarding the soft layer 5, and will not be described here.

In another example, the wear-resisting layer 6 may be laid on the upper surface of the soft layer 5 by snap-fitting. The manner of snap-fitting not only makes sure of a firm connection between the wear-resisting layer 6 and the soft layer 5, but also facilitates the assembly or disassembly between the wear-resisting layer 6 and the soft layer 5.

In an example, a lower surface of the wear-resisting layer 6 may be provided with multiple male or female members, and the upper surface of the soft layer 5 may be provided with multiple female or male members, then the connection between the soft layer 5 and the wear-resisting layer 6 may be implemented by the adaptive snapping of the male members with the female members. When a disassembly is required, one just needs to lift the wear-resisting layer 6 upwards.

In an example, the lower surface of the wear-resisting layer 6 may be provided with multiple fixture blocks, and the upper surface of the soft layer 5 may be provided with multiple fixture grooves adapted to the fixture blocks, then the connection between the wear-resisting layer 6 and the soft layer 5 may be implemented by the adaptive engagement of the fixture blocks with the fixture grooves. When a disassembly is required, one just needs to lift the wear-resisting layer 6 upwards.

A thickness of the wear-resisting layer 6 may be chosen according to specific applications. In an example, the thickness of the wear-resisting layer 6 may be between 0.3 mm and 0.5 mm, for example 0.3 mm, 0.4 mm, or 0.5 mm, etc. The thickness of the wear-resisting layer 6 is chosen in such a way that the thickness of the wear-resisting layer may adapt to the thickness of the soft layer 5, may prevent the wear of the soft layer 5, and may provide the user with a good touch for the feet and a comfortable running experience.

The wear-resisting layer 6 may be made of various materials with wear-resistance, plasticity or the like. In an example, the wear-resisting layer 6 may be made of poly tetra fluoroethylene, polyamide, or polyethylene terephthalate.

The use of poly tetra fluoroethylene (PTFE) provides the wear-resisting layer 6 with excellent properties in terms of corrosion resistance, lubrication and non-stickiness, electrical insulation, high temperature resistance and wear resistance or the like. The poly tetra fluoroethylene is also called Teflon.

The use of polyamide (PA) provides the wear-resisting layer 6 with excellent properties in terms of tensile strength, impact strength, rigidity, wear resistance and chemical resistance or the like. The polyamide is also called polyamide fiber.

The use of polyethylene terephthalate (PET) provides the wear-resisting layer 6 with excellent properties in terms of creep resistance, fatigue resistance, abrasion resistance and dimensional stability or the like. Further, PTFE, PA and PET have a low cost and are easy to obtain.

Figure 2C:
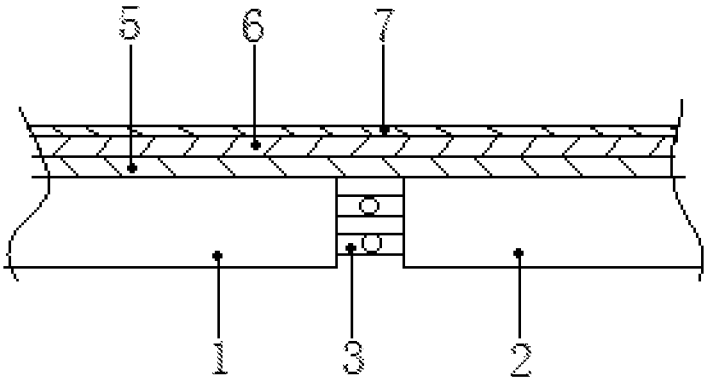
FIG. 2C is a partial enlarged view of the running deck assembly shown in FIG. 2B.

In order to prevent the noise resulting from the sliding friction between the wear-resisting layer 6 and the annular running belt 4, and to ensure a more smooth transmission of the annular running belt 4, the running deck assembly according to the examples of the present disclosure further includes a smooth layer 7, which is laid on the upper surface of the wear-resisting layer 6, as shown in FIG. 2C.

It should be understood that a friction coefficient of the smooth layer 7 should adapt to that of the annular running belt 4. This arrangement may not only prevent the noise resulting from the sliding friction between the wear-resisting layer 6 and the annular running belt 4, but also ensure a more smooth transmission of the annular running belt 4. Moreover, slipping phenomenon may be avoided when the user does exercise on the annular running belt 4.

The smooth layer 7 may be laid on the upper surface of the wear-resisting layer 6 in various ways. The following exemplary description is given with easy setting and high connecting strength.

In an example, the smooth layer 7 is laid on the wear-resisting layer 6 by adhering. The adhering facilitates the firm connection between the smooth layer 7 and the wear-resisting layer 6 made of different materials and is simple to perform. The specific arrangement for the smooth layer may refer to the description regarding the soft layer 5.

In another example, the smooth layer 7 may be laid on the upper surface of the wear-resisting layer 6 by spraying. The spraying facilitates the firm connection between the smooth layer 7 and the wear-resisting layer 6 made of different materials and is simple to perform.

The smooth layer 7 may be made of various materials with a friction coefficient less than that of the wear-resisting layer 6. In an example, the smooth layer 7 is made of a rubber material doped with graphite. Such material of the smooth layer 7 may not only provide the smooth layer 7 with a relatively low friction coefficient, but also provide a good touch for the feet of the user during running.

Figure 2D:
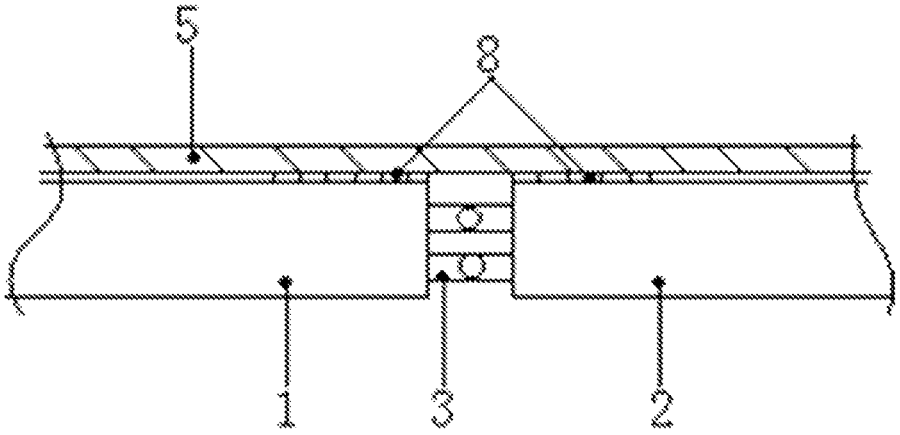
FIG. 2D is a partial enlarged view of the running deck assembly shown in FIG. 2A.

In an example, when the running deck assembly according to the examples of the present disclosure is folded or unfolded, in order to prevent a bump caused by the separation of parts of the soft layer 5 on two sides of the hinging gap from the front running deck 1 or from the rear running deck 2, the running deck assembly according to the examples of the present disclosure further includes first fasteners 8, which are configured to fasten, on two sides of the hinging gap, the connection between the soft layer 5 and the front and rear running decks 1, 2, as shown in FIG. 2D.

The first fastener 8 can be arranged in various forms, and some examples, in which the first fastener 8 is easy to arrange, are given below.

In an example, the first fasteners 8 are super glue layers, which adhere the soft layer 5 to the front running deck 1 and adhere the soft layer 5 to the rear running deck 2, on two sides of the hinging gap, see FIG. 2D.

The super glue layers may be 3M super glue layers.

It should be understood that if the soft layer 5 is laid on the upper surface of the front running deck 1 and the upper surface of the rear running deck 2 by adhering, the first fasteners 8 may be super glue layers with a larger thickness.

For the purpose of further improving the connecting strength between the soft layer 5 and the front and rear running decks 1, 2, a lower surface of the parts of the soft layer 5 on two sides of the hinging gap and the upper surfaces of the front running deck 1 and the rear running deck 2 may be provided with a rough structure. With this arrangement, when the super glue layers adhere the soft layer to the front and rear running decks, they may form first fasteners 8 with a higher connecting strength.

The dimension of the super glue layers positioned on two sides of the hinging gap may be determined depending on specific applications. In an example, a total length of the super glue layers positioned on two sides of the hinging gap in a front-rear direction is between 1 and 2 cm, for example, 1 cm, 1.2 cm, 1.4 cm, 1.6 cm, 1.8 cm, or 2 cm, etc.; the thickness of the super glue layer is between 0.1 and 0.2 mm, for example may be 0.1 mm, 0.12 mm, 0.14 mm, 0.16 mm, 0.18 mm, or 0.2 mm, etc.

It is noted that the total length of the super glue layers in the front-rear direction refers to a sum of a length of the super glue layer adhered on the front running deck 1 in the front-rear direction, a length of the hinging gap in the front-rear direction and a length of the super glue layer adhered on the rear running deck 2 in the front-rear direction.

With this dimension arrangement of the super glue layers positioned on two sides of the hinging gap, the connecting strength between the front running deck 1 and the soft layer 5 and the connecting strength between the rear running deck 2 and the soft layer 5, on two sides of the hinging gap, may be increased, such that a separation of the soft layer 5 from the front running deck 1 or from the rear running deck 2 may be prevented when the running deck assembly according to the examples of the present disclosure is folded or unfolded.

In an example, the first fasteners 8 are rivets, which rivet the soft layer 5 to the front running deck 1 and rivet the soft layer 5 to the rear running deck 2, on two sides of the hinging gap. The riveting not only ensures the firm connecting, on two sides of the hinging gap, between the soft layer 5 and the front running deck 1 and between the soft layer and the rear running deck 2, but also is convenient to perform, assemble and disassemble.

The rivets may be flexible rivets, or may be non-flexible rivets. For example, in the case of flexible rivets, the flexible rivets can be made of the same material as that of the soft layer 5, so as to prevent the user from feeling discomfort when doing exercise on the annular running belt 4.

In the case of non-flexible rivets, the soft layer 5 is provided with counter bores on two sides of the hinging gap, to avoid an influence on the comfort for the user when running. After the rivets are riveted to the front running deck 1 or the rear running deck 2 by passing through the counter bores, the heads of the rivets are sunk below the surface of the soft layer 5.

In an example, the first fasteners 8 are flexible binding components, which bind, on two sides of the hinging gap, the soft layer 5 with the front running deck 1, and bind the soft layer 5 with the rear running deck 2. By means of the flexible binding components, the soft layer 5 on two sides of the hinging gap may be banded with the front running deck 1 and banded with the rear running deck 2 in a convenient manner. Moreover, the flexible binding components are flexible and do not affect the comfort for the user when doing exercise on the annular running belt 4.

The flexible binding components may be flexible binding strips or flexible binding hoops. For example, in the case of the flexible binding strips, the flexible binding strips may be wound on the soft layer 5 and the front running deck 1 in the vicinity of the hinging gap, and wound on the soft layer 5 and the rear running deck 2 in the vicinity of the hinging gap, to allow, on two sides of the hinging gap, a firm connection between the soft layer 5 and the front and the rear running decks 1, 2.

In the case of flexible binding hoops, the flexible binding hoops may be mounted around the soft layer 5 and the front running deck 1 and mounted around the soft layer 5 and the rear running deck 2, on two sides of the hinging gap, to allow, on two sides of the hinging gap, a firm connection between the soft layer 5 and the front and the rear running decks 1, 2.

Figure 2E:
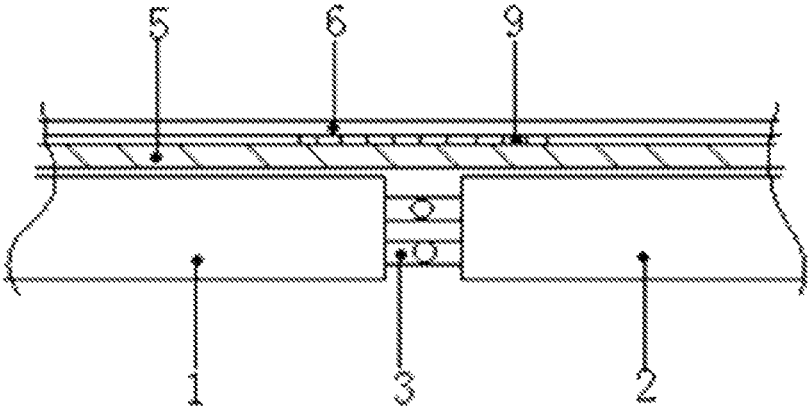
FIG. 2E is another partial enlarged view of the running deck assembly shown in FIG. 2B.

Further, in an example, when the running deck assembly according to the examples of the present disclosure is folded or unfolded, in order to prevent a bump caused by the separation of a part of the soft layer 5 at the hinging gap from the wear-resisting layer 6, the running deck assembly according to the examples of the present disclosure further includes a second fastener 9 which is configured to fasten the connection between the soft layer 5 and the wear-resisting layer 6 above the hinging gap, as shown in FIG. 2E.

The second fastener 9 can be arranged in various forms similar to the first fastener 8. On the premise of ease in arrangement, the second fastener 9 may be a super glue layer, see FIG. 2E.

It should be understood that if the wear-resisting layer 6 is laid on the soft layer 5 by adhering, the second fastener 9 may be a super glue layer with a larger thickness. In this case, the specific arrangement of the second fastener 9 may refer to that of the first fastener 8, and will not be described here.

The dimension of the second fastener 9 may be determined depending on specific applications. In an example, a length of each second fastener 9 in a front-rear direction is between 1 and 2 cm, for example, 1 cm, 1.2 cm, 1.4 cm, 1.6 cm, 1.8 cm, or 2 cm, etc. The thickness of each second fastener is between 0.1 and 0.2 mm, for example may be 0.1 mm, 0.12 mm, 0.14 mm, 0.16 mm, 0.18 mm, or 0.2 mm, etc. With this dimension arrangement of the second fastener 9, the connecting strength between the soft layer 5 and the wear-resisting layer 6 may be increased, and the dimension of the second fastener may match that of the soft layer 5 and that of the wear-resisting layer 6.

The rear end face of the front running deck 1 is hinged with the front end face of the rear running deck 2 by means of the hinge 3, to implement the folding and unfolding of the front running deck 1 and the rear running deck 2. As an example, the hinge 3 includes a first connection portion, a pin and a second connection portion. A front end of the first connection portion is connected to the rear end face of the front running deck 1, and a rear end of the first connection portion is provided with a first pin hole. A rear end of the second connection portion is connected to the front end face of the rear running deck 2, and a front end of the second connection portion is provided with a second pin hole. The pin is rotatably arranged in the first pin hole and in the second pin hole.

Figure 3:
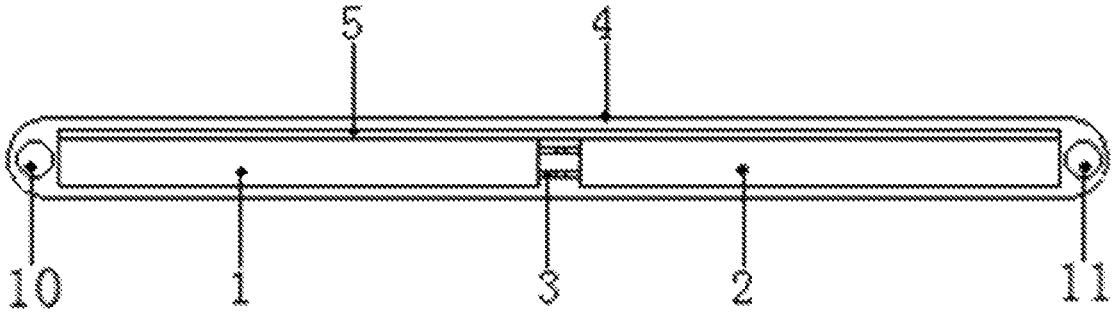
FIG. 3 is a front view of a running deck assembly provided with a front roller and a rear roller according to still another example.

As shown in FIG. 3, the running deck assembly according to the examples of the present disclosure further includes: a front roller 10, a rear roller 11, and a support (not shown). The support is configured to support the front running deck 1, the rear running deck 2, the front roller 10, and the rear roller 11. The front roller 10 is rotatably arranged in front of the front running deck 1, and the rear roller 11 is rotatably arranged at rear of the rear running deck 2. The annular running belt 4 is mounted around the front roller 10 and the rear roller 11 to allow the transmission around them. Meanwhile, the front running deck 1 and the rear running deck 2 are accommodated within the annular running belt, thus the annular running belt is mounted around the front running deck 1 and on the rear running deck 2 with a gap and is able to allow the transmission.

Figure 4:
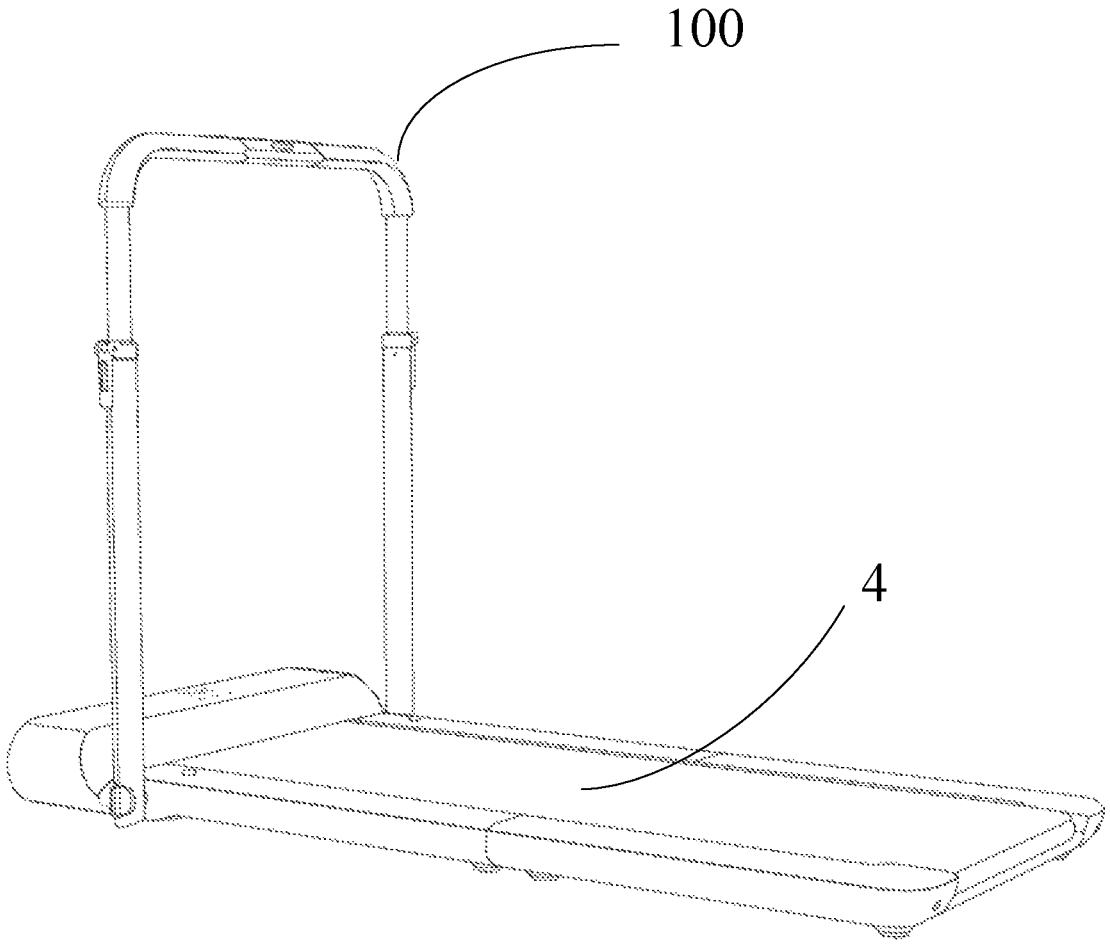
FIG. 4 is a side view of a treadmill, according to an example.

Diameter of each of the front roller 10 and the rear roller 11 is larger than a thickness of each of the front running deck 1 and the rear running deck 2. In a default state, there is a gap between the annular running belt 4 and the front and the rear running decks 1, 2, i.e. the annular running belt 4 is not completely in contact with the front running deck 1 and the rear running deck 2. During the exercise, a driving assembly drives the front roller 10, and the rear roller 11 is driven due to the transmission of the annular running belt 4. It should be understood that the annular running belt 4 is in direct contact with the wear-resisting layer 6 provided on the front running deck 1 and the rear running deck 2 when the feet of the user are located on the annular running belt 4. FIG. 4 shows a treadmill 100 with an annular running belt 4.

The examples of the present disclosure further provide a treadmill 100 including a running deck assembly, the running deck assembly including a front running deck; a rear running deck, wherein a front end face of the rear running deck is hinged with a rear end face of the front running deck by a hinge, and a hinging gap is located at a location where the front running deck is hinged to the rear running deck; an annular running belt, which is rotatably mounted around the front running deck and the rear running deck with a clearance; and a flexible layer, which is laid on an upper surface of the front running deck and an upper surface of the rear running deck and covers the hinging gap.

The running deck assembly according to the examples of the present disclosure is applied to the treadmill 100. When the treadmill 100 is in use, the running deck assembly is unfolded, and the user may obtain a comfortable experience due to the soft layer 5 provided in the running deck assembly. When storing the treadmill 100 up, the running deck assembly is folded, so as to reduce the occupied area and facilitate the storage.

Moreover, the soft layer 5 can be prevented from wear due to the wear-resisting layer 6 provided in the running deck assembly, and thus the service life of the soft layer 5 may be increased. The smooth layer 7 is laid on the upper surface of the wear-resisting layer 6, such that the sliding friction between the wear-resisting layer and the annular running belt 4 is reduced, thus the noise resulting from the friction during the transmission of the annular running belt 4 is prevented, and the annular running belt 4 can rotate more smoothly. This further improves the user experience of the treadmill 100.

As an example, the treadmill 100 further includes the driving assembly configured to drive the running deck assembly, and a control assembly configured to control the driving assembly.

Specifically, the control assembly is configured to control a working state and the output power of the driving assembly or the like. The driving assembly is configured to provide the front roller 10 and/or the rear roller 11 with a driving force, such that the front roller 10 and/or the rear roller 11 bring the annular running belt 4 into motion.

In an example, the driving assembly may only provide the front roller 10 with the driving force and drive the front roller into rotation. The rear roller 11 may be driven by the front roller 10 under the effect of a cooperation of the front roller 10 and the annular running belt 4. This implementation not only facilitates the simplification of the structure of the treadmill 100 with integration of the driving assembly and the control assembly in the front of the treadmill 100, but also is beneficial to reduce energy consumption.

In an example, the control assembly includes a controller, in which is provided a CPU (Central Processing Unit), to interpret and process the control instructions inputted into the controller by the user, and to send action instructions to the driving assembly, in order to control the driving assembly in operation.

In an example, the driving assembly includes a motor, which is transmissibly couple to the front roller 10 and is electrically connected to the controller. The controller controls the motor in operation. When the motor is in operation, it transmits the power to the front roller 10 and drives the front roller into rotation, thereby bringing annular running belt 4 into motion.

Upon studying the description and practicing the disclosure thereof, those skilled in the art will easily conceive other examples of the present disclosure. The present disclosure is intended to cover any variations, uses or adaptive modifications of the present disclosure, which follow the general principles of the present disclosure and include the common knowledge or conventional technical means in the art not disclosed by the present disclosure.

It should be understood that the present disclosure is not limited to the specific structures described above and shown in drawings, and may be modified and changed without departing from the scope thereof.

The invention claimed is:

1. A running deck assembly, comprising:

a front running deck comprising a rear end face;

a rear running deck comprising a front end face, wherein the front end face of the rear running deck is hinged with the rear end face of the front running deck by a hinge, and a hinging gap is located at a location where the front running deck is hinged to the rear running deck and is located between the rear end face of the front running deck and the front end face of the rear running deck;

an annular running belt, which is rotatably mounted around the front running deck and the rear running deck with a clearance; and a flexible layer in one-piece, which is laid on an upper surface of the front running deck and an upper surface of the rear running deck and covers the hinging gap, wherein the flexible layer is placed under a wear-resisting layer to protect the flexible layer from wearing, the wear-resisting layer is placed under a smooth layer for reducing noise, and the smooth layer has a friction coefficient that is less than a friction coefficient of the wear-resisting layer and adapted to a friction coefficient of the annular running belt, wherein the running deck assembly further comprises a first fastener which is located on a portion of the flexible layer above and opposite to the hinging gap, to fasten a connection between the flexible layer and the wear-resisting layer above the hinging gap.

2. The running deck assembly of claim 1, wherein the running deck assembly further comprises: second fasteners, configured to fasten, on two sides of the hinging gap, a connection between the flexible layer and the front running deck and a connection between the flexible layer and the rear running deck.

3. The running deck assembly of claim 2, wherein:

the second fasteners are super glue layers, which adhere the flexible layer to the front running deck and adhere the flexible layer to the rear running deck, on two sides of the hinging gap; or the second fasteners are flexible binding components, which bind the flexible layer with the front running deck, and bind the flexible layer with the rear running deck, on two sides of the hinging gap.

4. The running deck assembly of claim 1, wherein:

the flexible layer is laid on the upper surface of the front running deck and the upper surface of the rear running deck by adhering; or the flexible layer is laid on the upper surface of the front running deck and the upper surface of the rear running deck by snap-fitting.

5. The running deck assembly of claim 1, wherein a material of the flexible layer is ethylene-vinyl acetate copolymer or polyethylene.

6. The running deck assembly of claim 1, wherein the wear-resisting layer is laid on the upper surface of the flexible layer by adhering.

7. The running deck assembly of claim 1, wherein a material of the wear-resisting layer is one or a combination selected from a group consisting of: poly tetra fluoroethylene, polyamide, and polyethylene terephthalate.

8. The running deck assembly of claim 1, wherein the smooth layer comprises a rubber material doped with graphite.

9. A treadmill, comprising a running deck assembly, wherein the running deck assembly comprises:

a front running deck;

a rear running deck, wherein a front end face of the rear running deck is hinged with a rear end face of the front running deck by a hinge, and a hinging gap is located at a location where the front running deck is hinged to the rear running deck and is located between the rear end face of the front running deck and the front end face of the rear running deck;

an annular running belt, which is rotatably mounted around the front running deck and the rear running deck with a clearance; and a flexible layer in one-piece, which is laid on an upper surface of the front running deck and an upper surface of the rear running deck and covers the hinging gap, wherein the flexible layer is placed under a wear-resisting layer to protect the flexible layer from wearing, and the wear-resisting layer is placed under a smooth layer for reducing noise, and the smooth layer has a friction coefficient that is less than a friction coefficient of the wear-resisting layer and adapted to a friction coefficient of the annular running belt, wherein the running deck assembly further comprises a first fastener which is located on a portion of the flexible layer above and opposite to the hinging gap, to fasten a connection between the flexible layer and the wear-resisting layer above the hinging gap.

10. The treadmill of claim 9, wherein the running deck assembly further comprises: second fasteners, configured to fasten, on two sides of the hinging gap, a connection between the flexible layer and the front running deck and a connection between the flexible layer and the rear running deck.

11. The treadmill of claim 10, wherein:

the second fasteners are super glue layers, which adhere the flexible layer to the front running deck and adhere the flexible layer to the rear running deck, on two sides of the hinging gap; or the second fasteners are flexible binding components, which bind the flexible layer with the front running deck, and bind the flexible layer with the rear running deck, on two sides of the hinging gap.

12. The treadmill of claim 9, wherein:

the flexible layer is laid on the upper surface of the front running deck and the upper surface of the rear running deck by adhering; or the flexible layer is laid on the upper surface of the front running deck and the upper surface of the rear running deck by snap-fitting.

13. The treadmill of claim 9, wherein a material of the flexible layer is ethylene-vinyl acetate copolymer or polyethylene.

14. The treadmill of claim 9, wherein the wear-resisting layer is laid on the upper surface of the flexible layer by adhering.

15. The treadmill of claim 9, wherein a material of the wear-resisting layer is one or a combination selected from a group consisting of: poly tetra fluoroethylene, polyamide, and polyethylene terephthalate.

* * * * *